US010379453B2

(12) United States Patent
Nishitera

(10) Patent No.: US 10,379,453 B2
(45) Date of Patent: Aug. 13, 2019

(54) TONER

(71) Applicant: KYOCERA Document Solutions Inc., Osaka (JP)

(72) Inventor: Haruhiro Nishitera, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/155,365

(22) Filed: Oct. 9, 2018

(65) Prior Publication Data

US 2019/0113857 A1 Apr. 18, 2019

(30) Foreign Application Priority Data

Oct. 17, 2017 (JP) ..... 2017-200998

(51) Int. Cl.

| | |
|---|---|
| ***G03G 9/093*** | (2006.01) |
| ***G03G 9/08*** | (2006.01) |
| ***G03G 9/087*** | (2006.01) |
| ***G03G 9/09*** | (2006.01) |

(52) U.S. Cl.

CPC ..... *G03G 9/09371* (2013.01); *G03G 9/0819* (2013.01); *G03G 9/08755* (2013.01); *G03G 9/0904* (2013.01); *G03G 9/0906* (2013.01); *G03G 9/09392* (2013.01)

(58) Field of Classification Search

CPC ..... G03G 9/09371; G03G 9/0819; G03G 9/09392; G03G 9/08755; G03G 9/0906; G03G 9/0904

See application file for complete search history.

(56) References Cited

U.S. PATENT DOCUMENTS

2005/0058927 A1* 3/2005 Mikuriya ..... G03G 9/0825 430/110.2
2014/0255840 A1 9/2014 Sekiguchi et al.
2015/0248071 A1* 9/2015 Katsura ..... G03G 9/08755 430/109.3

FOREIGN PATENT DOCUMENTS

JP 2014-174262 A 9/2014

* cited by examiner

*Primary Examiner* — Thorl Chea

(74) *Attorney, Agent, or Firm* — Studebaker & Brackett PC

(57) ABSTRACT

A toner includes a plurality of first particles and a plurality of second particles. The first particles and the second particles each include a core and a shell layer covering a surface of the core. The cores of the first particles contain a binder resin and a colorant. The cores of the second particles contain a releasing agent. A standard deviation of a volume-based particle size distribution of the toner is no greater than 1.28. An area ratio of regions of the cores of the second particles that are occupied by the releasing agent in a cross-sectional image of the second particles is at least 50%. A number ratio of the second particles is at least 5% and no greater than 25% relative to a total number of the first particles and the second particles.

8 Claims, 1 Drawing Sheet

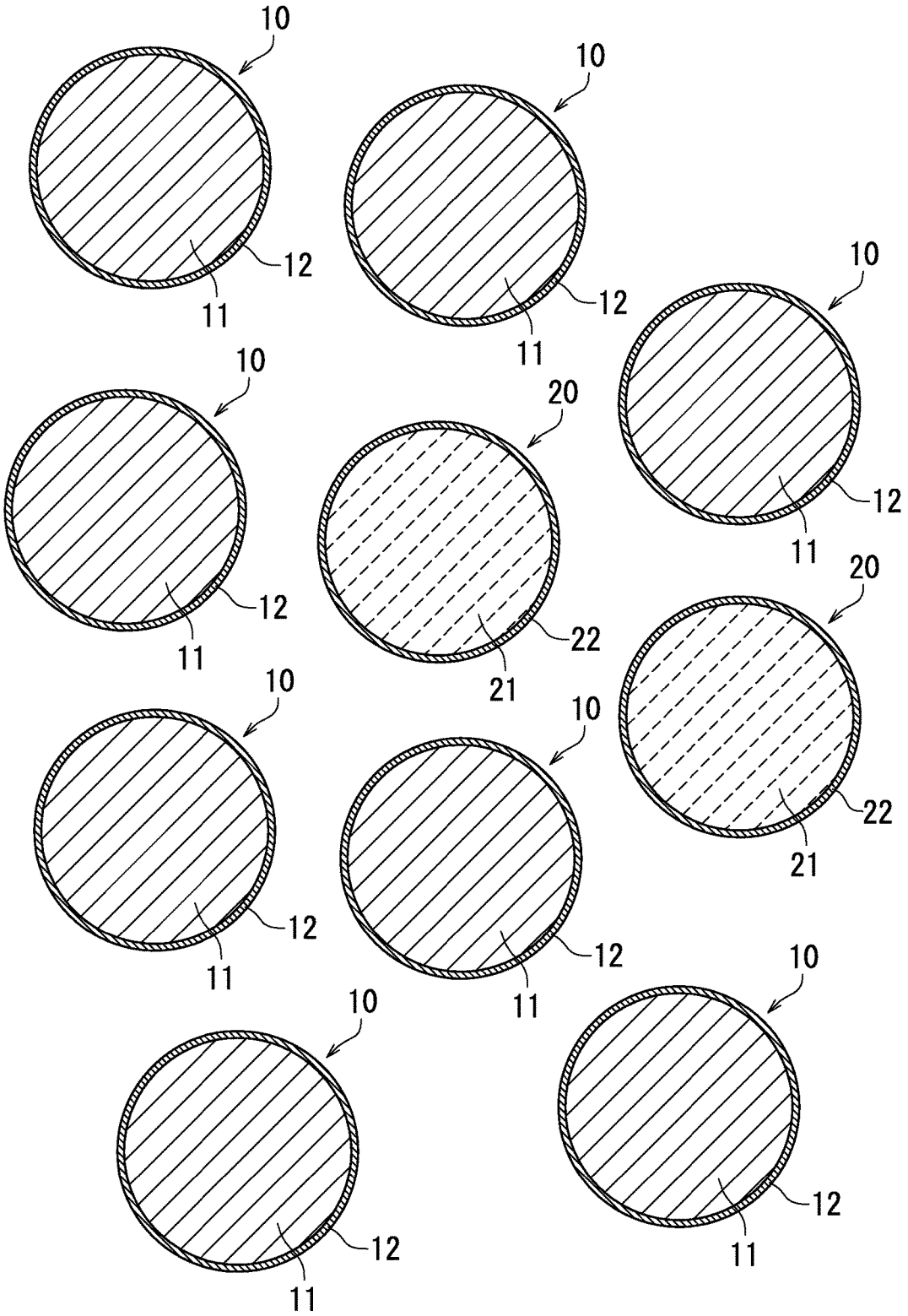
10
12
11
10
12
11
10
12
11
10
12
11
20
22
21
20
22
21
10
12
11
10
12
11
10
12
11
10
12
11

TONER

INCORPORATION BY REFERENCE

The present application claims priority under 35 U.S.C. § 119 to Japanese Patent Application No. 2017-200998, filed on Oct. 17, 2017. The contents of this application are incorporated herein by reference in their entirety.

BACKGROUND

The present disclosure relates to a toner.

In image formation on a recording medium with toner using an image forming apparatus, for example, a toner image formed with the toner is transferred to the recording medium. The transferred toner image is fixed to the recording medium by application of heat and pressure to the toner image for example using a fixing roller. In order to form high-quality images while reducing energy necessary for fixing, the toner is desired to have improved low-temperature fixability to a recording medium. In order to improve low-temperature fixability of the toner, a crystalline polyester resin and a non-crystalline resin are used for example as materials of the toner.

SUMMARY

A toner according to the present disclosure includes toner particles including a plurality of first particles and a plurality of second particles. The first particles and the second particles each include a core and a shell layer covering a surface of the core. The cores of the first particles contain a binder resin and a colorant. The cores of the second particles contain a releasing agent. A standard deviation of a volume-based particle size distribution of the toner is no greater than 1.28. An area ratio of regions of the cores of the second particles that are occupied by the releasing agent in a cross-sectional image of the second particles is at least 50%. A number ratio of the second particles is at least 5% and no greater than 25% relative to a total number of the first particles and the second particles.

BRIEF DESCRIPTION OF THE DRAWINGS

FIGURE illustrates an example of cross-sectional structure of first particles and second particles.

DETAILED DESCRIPTION

Embodiments of the present disclosure will be described below. Note that unless otherwise stated, evaluation results (for example, values indicating shape or physical properties) of a powder (specifically, toner particles or the like) are number averages of values measured with respect to an appropriate number of particles selected from the powder. A values for volume median diameter ($D_{50}$) of a powder are values for median diameters measured using a particle size distribution analyzer ("MULTISIZER 3", product of Beckman Coulter, Inc.) unless otherwise stated. Unless otherwise stated, a measurement value for a glass transition point (Tg) is a value measured using a differential scanning calorimeter ("DSC-6220", product of Seiko Instruments Inc.) in accordance with "Japanese Industrial Standard (JIS) K7121-2012". Unless otherwise stated, a measurement value for a melting point (Mp) is the temperature of a peak indicating maximum heat absorption on a heat absorption curve (vertical axis: heat flow (DSC signals), horizontal axis: temperature) measured using a differential scanning calorimeter ("DSC-6220", product of Seiko Instruments Inc.). Unless otherwise stated, a measurement value for a softening point (Tm) is a value measured using a capillary rheometer ("CFT-500D", product of Shimadzu Corporation). Unless otherwise stated, a measurement value for an acid value is a value measured in accordance with "Japanese Industrial Standard (JIS) K0070-1992".

In the following description, the term "-based" may be appended to the name of a chemical compound in order to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof. Furthermore, the term "(meth)acryl" may be used as a generic term for both acryl and methacryl.

First Embodiment: Toner

A toner according to the first embodiment can be favorably used for example as a positively chargeable toner for development of electrostatic latent images. The toner according to the present embodiment is a powder including a plurality of toner particles (particles having features described below). The toner may be used as a one-component developer. Alternatively, the toner may be mixed with a carrier using a mixer (for example, a ball mill) in order to prepare a two-component developer.

The toner particles of the toner according to the present embodiment include a plurality of first particles and a plurality of second particles. The first particles and the second particles each include a core and a shell layer covering a surface of the core. The cores of the first particles (also referred to below as first cores) contain a binder resin and a colorant. The cores of the second particles (also referred to below as second cores) contain a releasing agent. The first particles and the second particles may each further include an external additive attached to a surface of the shell layer. The shell layers of the first particles and the second particles contain for example a resin. In the first particles and the second particles, an additive may be dispersed in the resin forming the shell layers. The shell layers of the first particles (also referred to below as first shell layers) may entirely or partially cover surfaces of the first cores. Similarly, the shell layers of the second particles (also referred to below as second shell layers) may entirely or partially cover surfaces of the second cores. The first cores may contain an internal additive other than the colorant (specific examples include a releasing agent, a charge control agent, and a magnetic powder) as necessary. The second cores may contain at least one of a binder resin and internal additives other than the releasing agent (specific examples include a colorant, a charge control agent, and a magnetic powder) as necessary.

Furthermore, a standard deviation of a volume-based particle size distribution of the toner according to the present embodiment (also referred to below as a standard deviation SD) is no greater than 1.28. An area ratio of regions of the second cores that are occupied by the releasing agent in a cross-sectional image of the second cores (also referred to below as an area ratio $S_2$) is at least 50%. A number ratio of the second particles (also referred to below as a number ratio NR) is at least 5% and no greater than 25% relative to a total number of the first particles and the second particles.

In the present description, the standard deviation SD is measured according to a method indicated in Examples described further below or a method in accordance therewith.

Also, the area ratio $S_2$ is calculated according to the following expression (1). In the following expression (1), $S_A$ represents a number average area of regions of 500 second cores that are occupied by the releasing agent in a cross-sectional image of the second cores. Also in the following expression (1), $S_B$ represents a number average area of regions of the 500 second cores that are occupied by components other than the releasing agent in the cross-sectional image. Note that $S_A$ and $S_B$ are measured according to a method indicated in Examples described further below or a method in accordance therewith.

$$\text{Area ratio } S_2(\%)=100\times S_A/(S_A+S_B) \quad (1)$$

Also, the number ratio NR is calculated according to the following expression (2). In the following expression (2), $N_t$ represents a total number of the first particles and the second particles. In the following expression (2), $N_2$ represents the number of the second particles among $N_t$ particles. $N_t$ is 500, for example. Note that $N_2$ is measured according to a method indicated in Examples described further below or a method in accordance therewith.

$$\text{Number ratio NR } (\%)=100\times N_2/N_t \quad (2)$$

Low-temperature fixability can be ensured and glossiness of formed images can be increased with use of the toner having the above features according to the present embodiment. The reason thereof can be presumed as follows.

The toner according to the present embodiment has a comparatively narrow particle size distribution. The number ratio NR of the second particles that contain the releasing agent is at least 5% and no greater than 25% relative to the total number of the first particles and the second particles. Therefore, the second particles tend to be dispersed uniformly in a toner image developed with the toner according to the present embodiment. Consequently, a fixing inhibition factor involved in local presence of the releasing agent, which is endothermic, can be removed in the toner according to the present embodiment. Thus, it is thought that low-temperature fixability can be ensured.

The toner according to the present embodiment has a comparatively narrow particle size distribution, and the number ratio NR of the second particles is at least 5% and no greater than 25% relative to the total number of the first particles and the second particles. The second particles accordingly tend to be uniformly dispersed in a surface of an image formed with the toner according to the present embodiment. As a result of the releasing agent being comparatively uniformly dispersed in the surface of the formed image, surface roughness of the surface of the image is reduced to increase glossiness of the surface of the image. Consequently, it is thought that glossiness of formed images can be increased with use of the toner according to the present embodiment.

A lower limit is not particularly provided for the standard deviation SD in the present embodiment, but is preferably 1.23 in order to reduce production cost. Note that an example of a method for adjusting the standard deviation SD to no greater than 1.28 is a method by which the volume median diameter ($D_{50}$) of the second cores is approximated to that of the first cores in production of the second cores. A method for adjusting the volume median diameter ($D_{50}$) of the second cores will be described later. In the present embodiment, the area ratio $S_2$ is preferably at least 70%, and more preferably at least 85% in terms of an increase in glossiness of formed images. An upper limit is not particularly provided for the area ratio $S_2$, but is preferably at least 98% and more preferably 95% in order to facilitate production of the toner.

[Features of Toner Particles]

The following describes features of the toner particles (specifically, the first particles and the second particles) included in the toner according to the present embodiment with reference to FIGURE. FIGURE illustrates an example of cross-sectional structure of the first particles and the second particles included in the toner according to the present embodiment.

As illustrated in FIGURE, the toner particles of the toner according to the present embodiment include a plurality of first particles 10 and a plurality of second particles 20. Each of the first particles 10 includes a first core 11 and a first shell layer 12 covering a surface of the first core 11. The first cores 11 contain a binder resin and a colorant. Each of the second particles 20 includes a second core 21 and a second shell layer 22 covering a surface of the second core 21. The second cores 21 contain a releasing agent. The first particles 10 and the second particles 20 each are a capsule toner particle in which a core is covered with a shell layer. Amounts of charge of the first particles 10 and the second particle 20 can accordingly be adjusted to almost the same level. As a result of the amounts of charge thereof being adjusted to almost the same level, the first particles 10 and the second particles 20 are comparatively uniformly dispersed in a formed toner image. Accordingly, a fixing inhibition factor involved in local presence of the releasing agent can be removed.

In order to easily set the number ratio NR to be at least 5% and no greater than 25% in the toner according to the present embodiment, an amount of the second particles 20 is preferably at least 5 parts by mass and no greater than 20 parts by mass relative to 100 parts by mass of the first particles 10, and more preferably at least 10 parts by mass and no greater than 15 parts by mass.

In order to easily set the standard deviation SD of the toner according to the present embodiment to be no greater than 1.28, an absolute value of a difference in volume median diameter ($D_{50}$) between the first cores 11 and the second cores 21 is preferably no greater than 1.5 μm, and more preferably no greater than 1.0 μm. Note that a lower limit is not particularly provided for the absolute value of the difference in volume median diameter ($D_{50}$) between the first cores 11 and the second cores 21, and may be 0.0 μm.

In order to obtain a toner suitable for image formation, the volume median diameter ($D_{50}$) of the first cores 11 and that of the second cores 21 each are preferably at least 4.0 μm and no greater than 9.0 μm.

Note that the toner according to the present embodiment may include toner particles other than the first particles 10 and the second particles 20. In order to further increase glossiness of formed images while ensuring low-temperature fixability, a total amount of the first particles 10 and the second particles 20 among all toner particles in the toner according to the present embodiment is preferably at least 80% by mass, more preferably at least 90% by mass, and particularly preferably 100% by mass.

[Components of Toner Particle]

The following describes components of the toner particles included in the toner according to the present embodiment. Specifically, the first particles and the second particles are described in the stated order.

[First Particles]

The first particles each include the first core containing the binder resin and the colorant and the first shell layer covering the surface of the first core. The first cores may contain an internal additive other than the colorant (specific examples include a releasing agent, a charge control agent, and a magnetic powder) as necessary. The first particles may further include an external additive attached to surfaces of the first shell layers.

(Binder Resin)

The binder resin is a main component (for example, at least 80% by mass) of the first cores. Properties of the binder resin are therefore expected to have great influence on an overall property of the first cores. Combinational use of a plurality of resins as the binder resin can adjust properties (specific examples include hydroxyl value, acid value, Tg, and Tm) of the binder resin. When the binder resin has an ester group, a hydroxyl group, an ether group, an acid group, or a methyl group, the first cores have a strong tendency to be anionic. When the binder resin has an amino group or an amide group, the first cores have a strong tendency to be cationic.

In order to improve low-temperature fixability of the toner, the first cores preferably contain a thermoplastic resin as the binder resin, and more preferably contain a thermoplastic resin at a ratio of at least 85% by mass relative to a total mass of the binder resin. Examples of thermoplastic resins that can be contained in the first cores include styrene-based resins, (meth)acrylic acid ester-based resins, olefin-based resins (specific examples include polyethylene resin and polypropylene resin), vinyl resins (specific examples include vinyl chloride resin, polyvinyl alcohol, vinyl ether resin, and N-vinyl resin), polyester resins, polyamide resins, and urethane resins. Copolymers of the resins listed above, that is, copolymers obtained through incorporation of a repeating unit into any of the resins listed above (specific examples include styrene-(meth)acrylic acid ester-based resin and styrene-butadiene-based resin) can be used as the binder resin of the first cores.

The thermoplastic resin can be obtained through addition polymerization, copolymerization, or condensation polymerization of at least one type of thermoplastic monomer. Note that the thermoplastic monomer is a monomer to be a thermoplastic resin through homopolymerization (specific examples include (meth)acrylic acid ester-based monomer and styrene-based monomer) or a monomer to be a thermoplastic resin through condensation polymerization (specific examples include a combination of a polyhydric alcohol and a polybasic carboxylic acid that is to be a polyester resin through condensation polymerization).

In order to improve low-temperature fixability of the toner, the first cores preferably contain a polyester resin as the binder resin. The first cores preferably contain a mixture of a crystalline polyester resin and a non-crystalline polyester resin. As a result of the first cores containing a crystalline polyester resin and a non-crystalline polyester resin as the binder resin, low-temperature fixability can be improved while dispersibility of the colorant, which will be described later, can be increased. In a configuration as above, a mixing ratio between the crystalline polyester resin and the non-crystalline polyester resin is not particularly limited. For example, the crystalline polyester resin may be mixed in a range of at least 1 part by mass and no greater than 30 parts by mass relative to 100 parts by mass of the non-crystalline polyester resin.

In a configuration in which the first cores contain a crystalline polyester resin and a non-crystalline polyester resin, it is preferable that the non-crystalline polyester resin has a softening point of no greater than 90° C. and the non-crystalline polyester resin has a softening point of at least 100° C. in order to achieve both heat-resistant preservability and low-temperature fixability of the toner.

In order that the first cores have appropriate sharp meltability, the first cores preferably contain a crystalline polyester resin having a crystallinity index of at least 0.90 and no greater than 1.20 as the binder resin. The crystallinity index of the crystalline polyester resin can be adjusted by changing types or amounts (blending ratio) of monomers used for synthesis of the crystalline polyester resin. Note that the crystallinity index of a resin corresponds to a ratio (Tm/Mp) of a softening point (Tm, unit: ° C.) of the resin relative to a melting point (Mp, unit: ° C.) of the resin. Definite melting points Mp cannot be measured for non-crystalline resins in many cases. A resin having peak indicating maximum heat absorption that cannot be determined definitely on a heat absorption curve plotted using a differential scanning calorimeter can be determined to be a non-crystalline resin.

A polyester resin can be obtained through condensation polymerization between at least one polyhydric alcohol and at least one polybasic carboxylic acid. Examples of alcohols that can be used for synthesis of a polyester resin include dihydric alcohols (specific examples include diols and bisphenols) and tri- or higher-hydric alcohols listed below. Examples of carboxylic acids that can be used for synthesis of a polyester resin include dibasic carboxylic acids and tri- or higher-basic carboxylic acids listed below. Note that an anhydride of a polybasic carboxylic acid may be used in place of the polybasic carboxylic acid.

Examples of preferable diols include ethylene glycol, diethylene glycol, triethylene glycol, 1,2-propanediol, 1,3-propanediol, 1,4-butanediol, neopentyl glycol, 2-butene-1,4-diol, 1,5-pentanediol, 2-pentene-1,5-diol, 1,6-hexanediol, 1,4-cyclohexanedimethanol, dipropylene glycol, 1,4-benzenediol, polyethylene glycol, polypropylene glycol, and polytetramethylene glycol.

Examples of preferable bisphenols include bisphenol A, hydrogenated bisphenol A, bisphenol A ethylene oxide adduct, and bisphenol A propylene oxide adduct.

Examples of preferable tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of preferable dibasic carboxylic acids include maleic acid, fumaric acid, citraconic acid, itaconic acid, glutaconic acid, phthalic acid, isophthalic acid, terephthalic acid, cyclohexanedicarboxylic acid, adipic acid, sebacic acid, azelaic acid, malonic acid, succinic acid, alkyl succinic acids (specific examples include n-butylsuccinic acid, isobutylsuccinic acid, n-octylsuccinic acid, n-dodecylsuccinic acid, and isododecylsuccinic acid), and alkenyl succinic acids (specific examples include n-butenylsuccinic acid, isobutenylsuccinic acid, n-octenylsuccinic acid, n-dodecenylsuccinic acid, and isododecenylsuccinic acid).

Examples of preferable tri- or higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

Examples of preferable polyhydric alcohols that can be used for synthesis of a crystalline polyester resin include α,ω-alkanediols having a carbon number of at least 2 and no greater than 8 (specific examples include ethylene glycol, 1,4-butanediol, and 1,6-hexanediol). Examples of preferable polybasic carboxylic acids that can be used for synthesis of a crystalline polyester resin include α,ω-alkanedicarboxylic acids having a carbon number (including carbon atoms of two carboxyl groups) of at least 4 and no greater than 10 (specific examples include succinic acid and sebacic acid).

Examples of preferable polyhydric alcohols that can be used for synthesis of a non-crystalline polyester resin include bisphenols (specific examples include bisphenol A ethylene oxide adduct and bisphenol A propylene oxide adduct). Examples of preferable polybasic carboxylic acids that can be used for synthesis of a non-crystalline polyester resin include aromatic dicarboxylic acids (specific examples include terephthalic acid) and unsaturated dicarboxylic acids (specific examples include fumaric acid).

In a situation in which the first cores are produced by a later-described pulverization method with a crystalline polyester resin and a non-crystalline polyester resin, it is preferable to further use a styrene-(meth)acrylic acid ester-based resin as the binder resin. As a result of the binder resin including a styrene-(meth)acrylic acid ester-based resin, the crystalline polyester resin and the non-crystalline polyester resin are hardly compatible with each other in a melt-kneading process of the pulverization method. Therefore, interfaces are thought to be increased. A melt-kneaded substance accordingly tends to be well pulverized.

Examples of styrene-based monomers that can be used for synthesis of a styrene-(meth)acrylic acid ester-based resin include styrene, o-methylstyrene, m-methylstyrene, p-methylstyrene, p-phenylstyrene, p-ethylstyrene, 2,4-dimethylstyrene, p-t-butylstyrene, p-n-hexylstyrene, p-n-octylstyrene, p-n-nonylstyrene, p-n-decylstyrene, and p-n-dodecylstyrene.

Examples of (meth)acrylic acid ester-based monomers that can be used for synthesis of a styrene-(meth)acrylic acid ester-based resin include methyl (meth)acrylate, ethyl (meth)acrylate, n-propyl (meth)acrylate, iso-propyl (meth) acrylate, n-butyl (meth)acrylate, isobutyl (meth)acrylate, t-butyl (meth)acrylate, n-octyl (meth)acrylate, 2-ethylhexyl (meth)acrylate, stearyl (meth)acrylate, lauryl (meth)acrylate, and phenyl (meth)acrylate.

(Colorant)

The first cores contain a colorant. The colorant can be a commonly known pigment or dye that matches the color of the toner. In order to form high-quality images with the toner, the colorant is preferably contained in an amount of at least 1 part by mass and no greater than 20 parts by mass relative to 100 parts by mass of the binder resin.

The first cores may contain a black colorant. An example of the black colorant is carbon black. Alternatively, the black colorant may be a colorant whose color is adjusted to black using a yellow colorant, a magenta colorant, and a cyan colorant.

The first cores may contain a non-black colorant. Examples of non-black colorants include yellow colorants, magenta colorants, and cyan colorants.

At least one compound selected from the group consisting of condensed azo compounds, isoindolinone compounds, anthraquinone compounds, azo metal complexes, methine compounds, and arylamide compounds can for example be used as a yellow colorant. Examples of yellow colorants include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, or 194), Naphthol Yellow S, Hansa Yellow G, and C.I. Vat Yellow.

At least one compound selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds can for example be used as a magenta colorant. Examples of magenta colorants include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, or 254).

At least one compound selected from the group consisting of copper phthalocyanine compounds, anthraquinone compounds, and basic dye lake compounds can for example be used as a cyan colorant. Examples of cyan colorants include C.I. Pigment Blue (1, 7, 15, 15:1, 15:2, 15:3, 15:4, 60, 62, or 66), Phthalocyanine Blue, C.I. Vat Blue, and C.I. Acid Blue.

(Releasing Agent)

The first cores may contain a releasing agent. The releasing agent is for example used in order to improve offset resistance of the toner. In order to improve offset resistance of the toner, the releasing agent is preferably contained in an amount of at least 1 part by mass and no greater than 20 parts by mass relative to 100 parts by mass of the binder resin.

In a configuration in which the first cores contain a releasing agent, an area ratio of regions of the first cores that are occupied by the releasing agent (also referred to below as an area ratio $S_1$) is preferably at least 1% and no greater than 20%, and more preferably at least 5% and no greater than 10% in order to improve offset resistance of the toner while ensuring low-temperature fixability. Note that the area ratio $S_1$ is calculated by the same method as that for calculating the area ratio $S_2$ as described above.

Examples of releasing agents that can be preferably used include: aliphatic hydrocarbon-based waxes such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon-based waxes such as polyethylene oxide waxes and block copolymers of polyethylene oxide waxes; plant-based waxes such as candelilla wax, carnauba wax, Japan wax, jojoba wax, and rice wax; animal-based waxes such as beeswax, lanolin, and spermaceti; mineral-based waxes such as ozokerite, ceresin, and petrolatum; ester waxes having a fatty acid ester as a main component such as montanic acid ester wax and castor wax; and waxes in which a part or all of a fatty acid ester has been deoxidized such as deoxidized carnauba wax. In the present embodiment, one releasing agent may be used independently, or two or more releasing agents may be used in combination.

When the binder resin is a polyester resin, the releasing agent is preferably a carnauba wax, an ester wax, or a polyethylene wax. When the binder resin is a styrene-based resin or a copolymer of a styrene-based resin, the releasing agent is preferably a paraffin wax or a Fischer-Tropsch wax. A compatibilizer may be added to the first cores in order to improve compatibility between the binder resin and the releasing agent.

(Charge Control Agent)

The first cores may contain a charge control agent. The charge control agent is used for example in order to improve charge stability or a charge rise characteristic of the toner. The charge rise characteristic of the toner is an indicator as to whether or not the toner can be charged to a specific charge level in a short period of time.

Anionic strength of the first cores can be increased through the first cores containing a negatively chargeable charge control agent. By contrast, cationic strength of the first cores can be increased through the first cores containing a positively chargeable charge control agent. However, the first cores need not contain a charge control agent so long as sufficient chargeability of the toner can be ensured.

(Magnetic Powder)

The first cores may contain a magnetic powder. Examples of materials of the magnetic powder include ferromagnetic metals (specific examples include iron, cobalt, and nickel), alloys of ferromagnetic metals, oxides of ferromagnetic metals (specific examples include ferrite, magnetite, and chromium dioxide), and materials subjected to ferromagnetization (specifically, thermal treatment or the like). One magnetic powder may be used independently, or two or more magnetic powders may be used in combination.

(Production of First Cores)

Examples of methods for producing the first cores include an aggregation method and a pulverization method.

The aggregation method includes for example an aggregation process and a coalescence process. In the aggregation process, aggregated particles are formed by aggregating fine particles containing components forming the first cores in an aqueous medium. In the coalescence process, the first cores are formed by causing the components contained in the aggregated particles to coalesce in the aqueous medium. Note that the aggregation method generates much chemical wastewater and therefore an environmental load tends to increase.

The following describes the pulverization method. The pulverization method can produce the first cores comparatively easily and achieve reduction in production cost. Furthermore, the pulverization method involves no process by which much chemical wastewater is generated and an environmental load can therefore be reduced. Where the first cores are produced according to the pulverization method, the method for producing the first cores includes for example a melt-kneading process and a pulverization process. The method for producing the first cores may further include a mixing process before the melt-kneading process. The method for producing the first cores may further include at least one of a fine pulverization process and a classification process after the pulverization process.

In the mixing process, a mixture is obtained by mixing for example a binder resin and a colorant, and an internal additive other than the colorant to be added if necessary. In the melt-kneading process, a melt-kneaded substance is obtained for example by melting and kneading the mixture obtained through the mixing process. In the pulverization process, a pulverized product (first cores) is obtained by cooling the resultant melt-kneaded substance to for example room temperature (25° C.) and pulverizing the cooled substance. In a situation in which the pulverized product obtained through the pulverization process needs to be reduced in diameter, a process to further pulverize the pulverized product (fine pulverization process) may be performed. In order to average the particle diameter of the pulverized product, a process to classify the resultant pulverized product (classification process) may be performed. Through the above processes, the first cores that are a pulverized product is obtained.

(Shell Layers)

The shell layers (first shell layers) of the first particles may each be a film with or without granular appearance. In a situation in which resin particles are used as a material for forming the first shell layers, films with no granular appearance are thought to be formed as the first shell layers by hardening the material (resin particles) that is completely melt into a film state. By contrast, films in which the resin particles are two-dimensionally connected to one another (film with granular appearance) are thought to be formed as the first shell layers by hardening the material (resin particles) that is incompletely melt into a film state. The first shell layers each are not necessarily formed continuously as a whole. The first shell layers may each be a single film or a mass of a plurality of films (islands) interspersed in a separate manner, or include both resin particles and resin films.

The first shell layers may be made substantially from a thermosetting resin only or a thermoplastic resin only, or contain both a thermosetting resin and a thermoplastic resin. In a configuration in which the first shell layers contain both a thermosetting resin and a thermoplastic resin, a ratio between the thermosetting resin and the thermoplastic resin is arbitrary in the first shell layers.

In a configuration in which the binder resin of the first cores includes a polyester resin, the first shell layers preferably contain a vinyl resin including a repeating unit represented by the following formula (1-1) (also referred to below as a repeating unit (1-1)) and a repeating unit represented by the following formula (1-2) (also referred to below as a repeating unit (1-2)). In the following description, the vinyl resin including the repeating unit (1-1) and the repeating unit (1-2) may be referred to as a vinyl resin A.

(1-1)

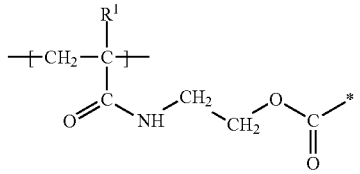

In formula (1-1), $R^1$ represents a hydrogen atom or an alkyl group optionally substituted by a substituent. The alkyl group includes a straight-chain alkyl group, a branched alkyl group, and a cyclic alkyl group. Preferably, $R^1$ represents a hydrogen atom, a methyl group, an ethyl group, or an isopropyl group. In formula (1-1), * represents a moiety connected to an atom in a polyester resin constituting the binder resin.

(1-2)

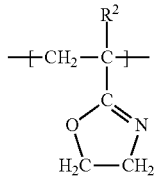

In formula (1-2), $R^2$ represents a hydrogen atom or an alkyl group optionally substituted by a substituent. The alkyl group includes a straight-chain alkyl group, a branched alkyl group, and a cyclic alkyl group. Preferably, $R^2$ represents a hydrogen atom, a methyl group, an ethyl group, or an isopropyl group.

The vinyl resin A includes the repeating unit (1-2) having an oxazoline group (closed ring). The oxazoline group has strong positive chargeability. Therefore, a positively chargeable toner excellent in charging property can be provided when the first shell layers contain the vinyl resin A. Examples of raw materials that can be used for forming the first shell layers containing the vinyl resin A include an aqueous solution of an oxazoline group-containing macromolecule ("EPOCROS (registered Japanese trademark) WS SERIES", product of Nippon Shokubai Co., Ltd.). "EPOCROS WS-300" and "EPOCROS WS-700" each contain a polymer of monomers (resin raw materials) including 2-vinyl-2-oxazoline and at least one (meth)acrylic acid alkyl ester. An example of methods for forming the shell layers using an aqueous solution of an oxazoline group-containing macromolecule is a method described in later-described Examples.

In order to obtain a toner suitable for image formation, the first shell layers preferably have a thickness of at least 50 nm and no greater than 400 nm. The thickness of the first shell layers can be measured by analyzing a transmission electron microscope (TEM) image showing cross sections of the first particles using commercially available image analysis software (for example, "WinROOF", product of Mitani Corporation). Note that if the thickness of the first shell layer is not uniform for a single first particle, the thickness of the first shell layer is measured at each of four locations that are approximately evenly spaced (specifically, four locations at which the first shell layer intersects with two orthogonal straight lines intersecting with each other at substantially the center of the cross section of the first toner particle) and the arithmetic mean of the four measured values is determined to be an evaluation value for the first particle (thickness of the first shell layer). Boundaries between the first cores and the first shell layers can be determined for example by selectively dying only the first shell layers among the first cores and the first shell layers. If the boundaries between the first cores and the first shell layers are indefinite in a TEM image, the boundaries between the first cores and the first shell layers can be clarified by mapping characteristic elements contained in the first shell layers in the TEM image through combination of TEM and electron energy loss spectroscopy (EELS).

In order to positively charge the first particles, the first shell layers may contain a positively chargeable charge control agent. Examples of preferable positively chargeable charge control agents are listed below. Note that derivatives or salts of the compounds listed below may be used as necessary.

Examples of positively chargeable charge control agents include: azine compounds such as pyridazine, pyrimidine, pyrazine, 1,2-oxazine, 1,3-oxazine, 1,4-oxazine, 1,2-thiazine, 1,3-thiazine, 1,4-thiazine, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline, and quinoxaline; direct dyes such as Azine Fast Red FC, Azine Fast Red 12BK, Azine Violet BO, Azine Brown 3G, Azine Light Brown GR, Axzine Dark Green BH/C, Azine Deep Black EW, and Azine Deep Black 3RL; acid dyes such as Nigrosine BK, Nigrosine NB, and Nigrosine Z; metal salts of naphthenic acids; metal salts of higher organic carboxylic acids; alkoxylated amine; alkylamide; quaternary ammonium salts such as benzyldecylhexylmethyl ammonium chloride, decyltrimethyl ammonium chloride, 2-(methacryloyloxy)ethyl trimethylammonium chloride, and dimethylaminopropyl acrylamide methyl chloride quaternary salt.

(External Additive)

The first particles may further include an external additive (a plurality of external additive particles) attached to surfaces of the first shell layers. Examples of methods for attaching an external additive to the surfaces of the first shell layers include a method by which external additive particles (powder) are attached to surfaces of toner mother particles (powder) in a manner to stir together the external additive particles and the toner mother particles in which the first cores are covered with the first shell layers.

In order to allow the external additive to sufficiently exhibit its function while inhibiting detachment of the external additive particles from the first shell layers, the external additive is preferably included in an amount (where plural types of external additive particles are used, a total amount of the external additive particles) of at least 0.5 parts by mass and no greater than 10 parts by mass relative to 100 parts by mass of the toner mother particles (specifically, toner mother particles in which the first cores are covered with the first shell layers).

Inorganic particles are preferable as the external additive particles. Particularly preferable external additive particles are silica particles or particles of metal oxides (specific examples include alumina, titanium oxide, magnesium oxide, zinc oxide, strontium titanate, and barium titanate). One type of external additive particles may be used independently, or two or more types of external additive particles may be used in combination.

The external additive particles may be subjected to surface treatment. For example, in a situation in which silica particles are used as the external additive particles, the silica particles may be made hydrophobic and/or positively chargeable with a surface treatment agent. Examples of surface treatment agents include coupling agents (specific examples include silane coupling agents, titanate coupling agents, and aluminate coupling agents), silazane compounds (specific examples include chain silazane compounds and ring silazane compounds), and silicone oils (specific examples include dimethyl silicone oil). A silane coupling agent or a silazane compound is particularly preferable as the surface treatment agent. Examples of preferable silane coupling agents include silane compounds (specific examples include methyltrimethoxysilane and aminosilane). An example of preferable silazane compounds is hexamethyldisilazane (HMDS). When a surface of a silica base (untreated silica particles) is treated with a surface treatment agent, a number of hydroxyl groups (—OH) present on the surface of the silica base are partially or fully substituted by functional groups derived from the surface treatment agent. As a result of substitution, silica particles having on surfaces thereof the functional groups derived from the surface treatment agent (specifically, functional groups more hydrophobic and/or more positively chargeable than the hydroxyl groups) are obtained.

[Second Particles]

The second particles each include the second core containing the releasing agent and the second shell layer covering the surface of the second core. The second cores may contain at least one of a binder resin and internal additives other than the releasing agent (specific examples include a colorant, a charge control agent, and a magnetic powder) as necessary. The second particles may further include an external additive attached to surfaces of the second shell layers. The releasing agent contained in the second cores is the same as the releasing agent described in the description of the first cores. Optional components of the second cores are the same as the components, such as the binder resin and the internal additives other than the releasing agent, described in the description of the first cores. The second shell layers are the same as the first shell layers. The external additive that is an optional component of the second particles is the same as the external additive described in the description of the first particles. No description is given of the contents overlapping with the description of the first particles.

In order to further increase glossiness of formed images, the second cores preferably contain no colorant.

The releasing agent contained in the second cores preferably has an acid value of at least 5 mgKOH/g and no greater than 25 mgKOH/g. When the acid value of the releasing agent contained in the second cores falls within the above range, adjustment of the volume median diameter ($D_{50}$) of the second cores can be facilitated. Thus, the standard deviation SD can be easily set to be no greater than 1.28. In order to easily set the standard deviation SD to be no greater than 1.28 while increasing glossiness of formed images, the releasing agent contained in the second cores is preferably a polyethylene oxide wax having an acid value of at least 5 mgKOH/g and no greater than 25 mgKOH/g.

(Production of Second Cores)

The following describes a preferable method for producing the second cores. First, a releasing agent is put into a vessel and heated to be melt. Next, an appropriate amount of a pH adjuster is added to the melted releasing agent. Examples of the pH adjuster include isopropanolamine. Subsequently, hot water is added to the resultant releasing agent while the releasing agent is stirred for phase inversion emulsification to obtain a roughly emulsified emulsion. Next, the resultant roughly emulsified emulsion is stirred using a homomixer while the temperature of the roughly emulsified emulsion is kept, and then treated using a homogenizer. Thereafter, cooling under stirring is performed to obtain a dispersion of the second cores.

In the preferable method for producing the second cores, the volume median diameter ($D_{50}$) of the second cores can be adjusted by changing the amount of the pH adjuster added to the melted releasing agent.

Second Embodiment: Toner Production Method

A toner production method according to the second embodiment is a preferable method for producing the toner according to the first embodiment and includes a melt-kneading process, a pulverization process, and a shell layer formation process. A plurality of the first cores are produced through the melt-kneading process and the pulverization process. In the shell layer formation process, shell layers are formed on the surfaces of the first cores and the surfaces of the second cores containing the releasing agent to obtain the first particles and the second particles. The toner production method according to the second embodiment may further include another process (for example, a process to attach an external additive to the surfaces of the shell layers). The toner obtained by the production method according to the second embodiment has a standard deviation of a volume-based particle size distribution of no greater than 1.28. In the toner obtained by the production method according to the second embodiment, an area ratio of regions of the second cores that are occupied by the releasing agent in a cross-sectional image of the second cores is at least 50%. In the toner obtained by the production method according to the second embodiment, a number ratio of the second particles is at least 5% and no greater than 25% relative to a total number of the first particles and the second particles. The following describes the respective processes. Note that no description is given of the contents overlapping with the description already given above of the toner according to the first embodiment.

[Melt-Kneading Process]

The melt-kneading process is the same as the melt-kneading process described in the description of the toner according to the first embodiment. Through the melt-kneading process, a melt-kneaded substance is obtained that contains a binder resin and a colorant, and an internal additive other than the colorant to be added if necessary. Note that the mixing process described in the first embodiment may be performed prior to the melt-kneading process.

[Pulverization Process]

The pulverization process is the same as the pulverization process described in the description of the toner according to the first embodiment. Through the pulverization processes, a pulverized product (first cores) is obtained. Note that at least one of the fine pulverization process and the classification process described in the first embodiment may be performed after the pulverization process.

[Shell Layer Formation Process]

Examples of shell layer formation methods include in-situ polymerization, in-liquid curing film coating, and coacervation. A preferable specific example is the following method.

First, the first cores obtained through the melt-kneading process and the pulverization process described above and the second cores are put into an aqueous medium in which a raw material for shell layer formation (shell raw material) is dissolved. The second cores can be obtained for example by the same method as the preferable method for producing the second cores described in the description of the toner according to the first embodiment. In the above case, a dispersion of the second cores may be put into the aqueous medium.

Next, polymerization reaction of the shell raw material (or cross-linking reaction of the shell raw material) is caused to proceed by heating the aqueous medium containing the first cores and the second cores to form shell layers on the surfaces of the first cores and the surfaces of the second cores, thereby obtaining a plurality of first particles and a plurality of second particles.

Through the above, the toner production method according to the second embodiment has been described. According to the toner production method in the second embodiment, the toner according to the first embodiment, use of which can increase glossiness of formed images and ensure low-temperature fixability, can be produced easily at low cost.

EXAMPLES

The following describes Examples according to the present disclosure. A method for synthesizing the binder resin will be described first.

<Synthesis of Binder Resin>

[Synthesis of Non-Crystalline Polyester Resin R1]

A 10-L four-necked flask equipped with a thermometer (thermocouple), a falling-type condenser, a nitrogen inlet tube, and a stirrer was charged with 100 g of a bisphenol A ethylene oxide adduct (average number of moles added of ethylene oxide: 2 mol), 100 g of a bisphenol A propylene oxide adduct (average number of moles added of propylene oxide: 2 mol), 50 g of terephthalic acid, 30 g of adipic acid, and 54 g of tin(II) 2-ethylhexanoate. Once the internal temperature of the flask was then increased up to 235° C., a reaction was caused at the same temperature until all raw materials (monomers) in the flask were melted. Next, a reaction was caused in a reduced pressure atmosphere (pressure: 8 kPa) at a temperature of 235° C. until a glass transition point (Tg) of the reaction product reached 30° C. and a softening point (Tm) of the reaction product reached 90° C. to obtain a non-crystalline polyester resin R1.

[Synthesis of Non-crystalline Polyester Resin R2]

A 10-L four-necked flask equipped with a thermometer (thermocouple), a falling-type condenser, a nitrogen inlet tube, and a stirrer was charged with 100 g of a bisphenol A ethylene oxide adduct (average number of moles added of ethylene oxide: 2 mol), 100 g of a bisphenol A propylene oxide adduct (average number of moles added of propylene oxide: 2 mol), 60 g of terephthalic acid, and 54 g of tin(II) 2-ethylhexanoate. Once the internal temperature of the flask was then increased up to 235° C., a reaction was caused at the same temperature until all raw materials (monomers) in the flask were melted. Next, 10 g of trimellitic anhydride was added into the flask. Then, a reaction was caused in a reduced pressure atmosphere (pressure: 8 kPa) at a temperature of 235° C. until a glass transition point (Tg) of the reaction product reached 50° C. and a softening point (Tm) of the reaction product reached 110° C. to obtain a non-crystalline polyester resin R2.

[Synthesis of Composite Resin of Crystalline Polyester Resin and Styrene-butyl Methacrylate Copolymer]

A 10-L four-necked flask equipped with a thermometer (thermocouple), a falling-type condenser, a nitrogen inlet tube, and a stirrer was charged with 69 g of ethylene glycol, 214 g of sebacic acid, and 54 g of tin(II) 2-ethylhexanoate. The internal temperature of the flask was then increased up to 235° C. in a heating mantle in a nitrogen atmosphere (heating time: 2 hours). Thereafter, a reaction was caused at 235° C. Once a reaction rate reached 95%, the internal temperature of the flask was lowered to 160° C. The reaction rate was calculated according to an expression "reaction rate=100×(actual amount of reaction product water)/(theoretical amount of reaction product water)". Subsequently, a mixed solution of 156 g of styrene, 195 g of butyl methacrylate, and 0.5 g of dibutyl peroxide was dripped into the flask over 1 hour. Thereafter, the internal temperature of the flask was kept at 160° C. for 30 minutes and then increased up to 200° C. Next, a reaction was caused for 1 hour in a reduced pressure atmosphere (pressure: 8 kPa) at a temperature of 200° C. and the internal temperature of the flask was then lowered to 180° C. Thereafter, 1.0 g of 4-t-butylcatechol, which is a radical polymerization inhibitor, was added into the flask and the internal temperature of the flask was increased up to 210° C. over 2 hours. After a reaction was caused for 1 hour at 210° C., a further reaction was caused for 1 hour under conditions of a pressure of 40 kPa and a temperature of 210° C. to obtain a composite resin of a crystalline polyester resin and a styrene-butyl methacrylate copolymer (also referred to below as a composite resin R3).

<Core Production>

[Production of Cores C1A-1]

An FM mixer ("FM-20B", product of Nippon Coke & Engineering Co., Ltd.) was used to mix 35 parts by mass of the non-crystalline polyester resin R1, 35 parts by mass of the non-crystalline polyester resin R2, 12 parts by mass of the composite resin R3, 9 parts by mass of a releasing agent (ester wax: "NISSAN ELECTOL (registered Japanese trademark) WEP-8", product of NOF Corporation), and 9 parts by mass of a colorant (carbon black: "MA-100", product of Mitsubishi Chemical Corporation). Next, the resultant mixture was melt-kneaded using a twin screw extruder ("PCM-30", product of Ikegai Corp.) under conditions of a material feeding rate of 100 g/minute, a shaft rotational speed of 150 rpm, and a cylinder temperature of 100° C. The resultant melt-kneaded substance was then cooled. Subsequently, the cooled melt-kneaded substance was coarsely pulverized using a pulverizer ("ROTOPLEX (registered Japanese trademark)", product of Hosokawa Micron Corporation) under a condition of a set particle diameter of 2 mm (pulverization process). The resultant coarsely pulverized product was finely pulverized (fine pulverization process) using a pulverizer ("TURBO MILL TYPE RS", product of FREUND-TURBO CORPORATION). Subsequently, the resultant finely pulverized product was classified using a classifier (classifier utilizing Coanda effect: "ELBOW JET TYPE EJ-LABO", product of Nittetsu Mining Co., Ltd.). Through the above, cores C1A-1 were obtained that have a volume median diameter ($D_{50}$) of 6.7 μm. Note that the cores C1A-1 are equivalent to the first cores described above.

[Production of Cores C2A-1]

A vessel was charged with 25.0 parts by mass of a polyethylene oxide wax ("HI-WAX 4252E", product of Mitsui Chemicals, Inc.) having an acid value of 20 mgKOH/g and a melting point of 95° C. The polyethylene oxide wax was then melted by being heated at 100° C. Next, 2.0 parts by mass of isopropanolamine was added to the melted polyethylene oxide wax and 73.0 parts by mass of hot water at a temperature of 90° C. was added to the resultant substance over 1 minute under stirring for phase inversion emulsification. After the phase inversion emulsification, the resultant roughly emulsified emulsion was stirred for 1 minute at a rotational speed of 3,000 rpm using a homomixer ("T. K. HOMOMIXER", product of PRIMIX Corporation) while being kept at 90° C. Next, the roughly emulsified emulsion after the stirring was treated using a homogenizer ("15MR-STA", product of APV GAULIN, INC.) under a condition of a pressure of 400 kgf/cm$^2$. The treated substance was then cooled to 38° C. under stirring to obtain a dispersion of cores C2A-1 having a volume median diameter ($D_{50}$) of 6.8 μm and a melting point of 86° C. A concentration of the cores C2A-1 in the resultant dispersion was 25% by mass. The cores C2A-1 contained neither a colorant nor a surfactant. Note that the cores C2A-1 are equivalent to the second cores described above.

[Production of Cores C2A-2]

The same treatment was performed as that for the cores C2A-1 in all aspects other than that the amount of isopropanolamine was changed to 2.5 parts by mass and the amount of hot water was changed to 72.5 parts by mass to obtain a dispersion of cores C2A-2 having a volume median diameter ($D_{50}$) of 7.4 μm and a melting point of 85° C. A concentration of the cores C2A-2 in the resultant dispersion was 25% by mass. The cores C2A-2 contained neither a colorant nor a surfactant. Note that the cores C2A-2 are equivalent to the second cores described above.

[Production of Cores C2A-3]

The same treatment was performed as that for the cores C2A-1 in all aspects other than the following changes to obtain a dispersion of cores C2A-3 having a volume median diameter ($D_{50}$) of 6.7 μm and a melting point of 85° C. A concentration of the cores C2A-3 in the resultant dispersion was 25% by mass. The cores C2A-3 also contained neither a colorant nor a surfactant. Note that the cores C2A-3 are equivalent to the second cores described above.

(Changes)

The polyethylene oxide wax used for producing the cores C2A-1 was changed to a polyethylene oxide wax (prototype of Mitsui Chemicals, Inc.) having an acid value of 10 mgKOH/g and a melting point of 95° C. The amount of isopropanolamine was changed to 3.0 parts by mass. The amount of hot water was changed to 72.0 parts by mass.

[Production of Cores C2B-1]

The same treatment was performed as that for the cores C2A-1 in all aspects other than that the amount of isopropanolamine was changed to 1.5 parts by mass and the amount of hot water was changed to 73.5 parts by mass to obtain a dispersion of cores C2B-1 having a volume median diameter ($D_{50}$) of 4.8 μm and a melting point of 84° C. A concentration of the cores C2B-1 in the resultant dispersion was 25% by mass. The cores C2B-1 also contained neither a colorant nor a surfactant. Note that the cores C2B-1 correspond to the second cores described above.

[Production of Cores C2B-2]

The same treatment was performed as that for the cores C2A-1 in all aspects other than that the amount of isopropanolamine was changed to 3.0 parts by mass and the amount of hot water was changed to 72.0 parts by mass to obtain a dispersion of cores C2B-2 having a volume median diameter ($D_{50}$) of 8.7 μm and a melting point of 87° C. A concentration of the cores C2B-2 in the resultant dispersion was 25% by mass. The cores C2B-2 also contained neither a colorant nor a surfactant. Note that the cores C2B-2 correspond to the second cores described above.

<Toner Production>

[Production of Toner TA-1]

(Production of Toner Mother Particles T1)

The internal temperature of a three-necked flask charged with 100.0 parts by mass of ion exchanged water was kept at 30° C. using a water bath. The flask was equipped with a thermometer and a stirring impeller. Next, 8.0 parts by mass of an aqueous oxazoline group-containing macromolecule solution ("EPOCROS WS-300", product of Nippon Shokubai Co., Ltd.) as a shell layer raw material was added into the flask and the flask contents were stirred. Then, the cores C1A-1 (71.8 parts by mass) obtained by the above-described method and the dispersion (20.2 parts by mass) of the cores C2A-1 obtained by the above-described method were added into the flask and the flask contents were stirred for 1 hour at a rotational speed of 200 rpm. Subsequently, 100.0 parts by mass of ion exchanged water was added into the flask and 2.0 parts by mass of an aqueous ammonia solution (concentration: 1% by mass) was further added thereto. The internal temperature of the flask was then increased up to 60° C. at a heating rate of 0.5° C./minute while the flask contents were stirred at a rotational speed of 150 rpm. Once the internal temperature of the flask reached 60° C., 2.0 parts by mass of an aqueous solution was added into the flask. The aqueous solution was obtained by diluting an aqueous polyacrylic acid solution ("HL-415", product of Nippon Shokubai Co., solid concentration: 45% by mass) to 10% by mass with purified water. Thereafter, the flask contents were stirred for 1 hour under conditions of a temperature of 60° C. and a rotational speed of 100 rpm. After the stirring, 1% by mass of an aqueous ammonia solution was added into the flask to adjust the pH of the flask contents to 7. Then, the flask contents were cooled to 25° C. to obtain a dispersion including a number of toner mother particles T1.

The resultant dispersion of the toner mother particles T1 was filtered (solid-liquid separation) using a Buchner funnel to collect a wet cake of the toner mother particles T1. The wet cake of the toner mother particles T1 was re-dispersed in ion exchanged water, and filtration using a Buchner funnel was then performed. Re-dispersion and filtration were further performed five times to wash the toner mother particles T1.

Next, a wet cake of the toner mother particles T1 was dispersed in an aqueous ethanol solution at a concentration of 50% by mass. Through the above, a slurry of the toner mother particles T1 was obtained. The toner mother particles T1 in the slurry were then dried using a continuous surface-modifying apparatus ("COATMIZER (registered Japanese trademark)", product of Freund Corporation) under conditions of a hot air temperature of 45° C. and a flow rate of 2 $m^3$/minute. As a result, a powder of the toner mother particles T1 was obtained. The powder of the toner mother particles T1 included a number of toner mother particles in each of which a core C1A-1 was covered with a shell layer and a number of toner mother particles in each of which a core C2A-1 is covered with a shell layer.

(External Addition Process)

An FM mixer ("FM-10B", product of Nippon Coke & Engineering Co., Ltd.) was used to mix 100 parts by mass of the toner mother particles T1 and 3 parts by mass of dry silica fine particles ("AEROSIL (registered Japanese trademark) REA90", product of Nippon Aerosil Co., Ltd.) for 5 minutes under conditions of a rotational speed of 3,500 rpm and a jacket temperature of 20° C. Through the above mixing, an external additive (dry silica fine particles) was attached to surfaces of the toner mother particles T1. Subsequently, the resultant powder was sifted using a 200-mesh sieve (sieve opening: 75 μm). Through the sifting, a toner TA-1 including a number of toner particles was obtained.

[Production of Toners TA-2 to TA-5 and TB-1 to TB-5]

Toners TA-2 to TA-5 and TB-1 to TB-5 were produced according to the same method as that for the toner TA-1 in all aspects other than the following changes.

(Changes)

With respect to each of the toners TA-2 to TA-5 and TB-1 to TB-5, the amount of the first cores, the type and amount of the second cores, and the amount of the aqueous oxazoline group-containing macromolecule solution were changed to those listed in Table 1. Note that values under a column "Amount" under "Second core" in Table 1 each indicate an amount of the dispersion of the second cores used (dispersion of the second cores obtained by the above-described method).

TABLE 1

| | First core | | Second core | | Aqueous oxazoline group-containing macromolecule |
|---|---|---|---|---|---|
| Toner | Type | Amount (part by mass) | Type | Amount (part by mass) | solution Amount (part by mass) |
| TA-1 | C1A-1 | 71.8 | C2A-1 | 20.2 | 8.0 |
| TA-2 | C1A-1 | 50.5 | C2A-1 | 42.7 | 6.8 |
| TA-3 | C1A-1 | 80.7 | C2A-1 | 10.7 | 8.6 |
| TA-4 | C1A-1 | 71.8 | C2A-2 | 20.2 | 8.0 |
| TA-5 | C1A-1 | 71.8 | C2A-3 | 20.2 | 8.0 |
| TB-1 | C1A-1 | 71.8 | C2B-1 | 20.2 | 8.0 |
| TB-2 | C1A-1 | 71.8 | C2B-2 | 20.2 | 8.0 |
| TB-3 | C1A-1 | 44.8 | C2A-2 | 48.7 | 6.5 |
| TB-4 | C1A-1 | 44.8 | C2A-1 | 48.7 | 6.5 |
| TB-5 | C1A-1 | 84.6 | C2A-1 | 6.6 | 8.8 |

<Measuring Method and Evaluation Method>

[Standard Deviation SD]

With respect to each of the toners TA-1 to TA-5 and TB-1 to TB-5, 20 mg of the toner used for evaluation, 1 mL of sodium alkyl ether sulfate, and 50 mL of an electrolytic solution ("ISOTON-2", product of Beckman Coulter, Inc.) were mixed together. Subsequently, 3-minute ultrasonic wave irradiation at a frequency of 24 kHz was performed on the resultant mixture using an ultrasonic disperser ("VS-D100", product of AS ONE Corporation). Through the above, an evaluation dispersion was obtained. Subsequently, a volume-based particle size distribution of the toner in the evaluation dispersion was measured using a particle size distribution analyzer ("MULTISIZER 3", product of Beckman Coulter, Inc.) under conditions of an aperture diameter of 100 μm and a measured particle count of 50,000. A standard deviation SD was determined from the measured volume-based particle size distribution. Table 2 shows results.

[Area Ratios $S_1$ and $S_2$]

(Area Ratio $S_2$)

The following describes a method for measuring an area ratio $S_2$. The toner used for evaluation and a releasing agent powder used in production of the toner were sufficiently dispersed in a photocurable epoxy resin ("ARONIX (registered Japanese trademark) LCR D-800", product of Toagosei Co., Ltd.), and then hardening was performed for 2 days in an atmosphere at a temperature of 40° C. under ultraviolet irradiation. After the hardening, the resultant hardened product was sliced using a microtome in which a diamond knife was set to obtain a thin piece. The resultant thin piece was placed on a copper mesh and dyed with ruthenium though 5-minute exposure in a vapor of an aqueous ruthenium tetroxide solution (concentration: 0.5% by mass). An image of section of the dyed sample piece was then captured using a transmission electron microscope (TEM, "H-7100FA", product of Hitachi High-Technologies Corporation). A difference in image brightness can be observed between regions occupied by a releasing agent and regions occupied by components other than the releasing agent in the cross-sectional image according to the presence or absence of dye. In view of the above fact, regions occupied by the releasing agent and regions occupied by the components other than the releasing agent were distinguished from each other through analysis on the cross-sectional image using image analysis software ("WinROOF", product of Mitani Corporation). Specifically, image brightness of the releasing agent was first analyzed in a cross-sectional image of the releasing agent powder to determine the lowest brightness (also referred to below as a LB value) of the releasing agent. Next, brightness of respective cores was analyzed in the cross-sectional image of the toner to determine regions having a brightness of equal to or larger than the LB value to be regions occupied by the releasing agent (non-dyed bright regions) and regions having a brightness of smaller than the LB value to be regions occupied by the components other than the releasing agent (dyed dark regions). Subsequently, 500 cores (second cores) having an area ratio of regions occupied by the releasing agent of at least 50% were selected from among the cores in the cross-sectional image. A number average area $S_A$ of the regions occupied by the releasing agent and a number average area $S_B$ of the regions occupied by the components other than the releasing agent of the 500 second cores in the cross-sectional image were calculated using the aforementioned image analysis software. An area ratio $S_2$ was then calculated according to the following expression (1). Table 2 shows results.

$$\text{Area ratio } S_2(\%)=100\times S_A/(S_A+S_B) \quad (1)$$

(Area Ratio $S_1$)

The cross-sectional image was analyzed according to the same method as for the area ratio $S_2$ using the image analysis software ("WinROOF", product of Mitani Corporation), and 500 cores (first cores) having an area ratio of regions occupied by the releasing agent of less than 50% were selected from among the cores in the cross-sectional image. A number average area of regions occupied by the releasing agent and a number average area of regions occupied by the components other than the releasing agent of the 500 first cores in the cross-sectional image were calculated using the image analysis software. An area ratio $S_1$ was then calculated in a manner similar to that for the area ratio $S_2$. Table 2 shows results.

[Number Ratio NR]

The cross-sectional image was analyzed by the same method as that for the area ratio $S_2$ using the image analysis software ("WinROOF", product of Mitani Corporation), and 500 particles were selected at random from among the particles in the cross-sectional image. Particles including the second cores were identified from among the selected 500 particles by the same method as for the area ratio $S_2$, and the number $N_2$ of the identified particles was counted. A number ratio NR was calculated according to the following expression (2). Table 2 shows results. Note that $N_t$ represents 500 in the following expression (2).

$$\text{Number ratio NR } (\%)=100\times N_2/N_t \quad (2)$$

[Low-Temperature Fixability]

With respect to each of the toners TA-1 to TA-5 and TB-1 to TB-5, 100 parts by mass of a developer carrier (carrier for "TASKalfa 5550ci" produced by KYOCERA Document Solutions Inc.) and 10 parts by mass of the toner used for evaluation were mixed for 30 minutes using a ball mill to prepare an evaluation developer (two-component developer).

An evaluation apparatus used was a color printer ("FS-05250DN" product of KYOCERA Document Solutions Inc.) modified to enable adjustment of fixing temperature. The two-component developer prepared as above was loaded into a development device for black color of the evaluation apparatus, and a toner for replenishment use (toner used for evaluation) was loaded into a toner container for black color of the evaluation apparatus.

A black solid image (specifically, an unfixed toner image) having a size of 25 mm by 25 mm was formed on evaluation paper ("COLOR COPY (registered Japanese trademark)", product of Mondi, A4 size, basis weight: 90 g/m$^2$) using the evaluation apparatus under a condition of a toner application amount of 1.0 mg/cm$^2$ in an environment at a temperature of 23° C. and a relative humidity of 50%. Subsequently, the evaluation paper with the image formed thereon was allowed to pass through a fixing device of the evaluation apparatus. In doing so, the temperature of the fixing device was decreased in decrements of 2° C. from 140° C. and fixability was determined at respective fixing temperatures. Further, a minimum temperature (lowest fixable temperature) at which the solid image (toner image) was fixable to the evaluation paper was determined. Fixing of the toner was confirmed by a folding and rubbing test such as described below. Specifically, the evaluation paper having passed through the fixing device was folded in half with a surface on which the image was formed facing inward so that a fold was located at the center of the image, and a 1-kg brass weight covered with cloth was rubbed back and forth on the fold five times. The evaluation paper was opened up then, and the folded portion of the evaluation paper (part where the solid image was formed) was observed. A length of peeling of the toner (peeling length) in the folded portion was measured. A minimum temperature among temperatures for which the peeling length was no greater than 1 mm was determined to be the lowest fixable temperature. Table 2 shows results. Low-temperature fixability was evaluated as "good" when the lowest fixable temperature was less than 108° C. Low-temperature fixability was evaluated as "poor" when the lowest fixable temperature was at least 108° C.

[Fixing Temperature Range]

A black solid image (specifically, an unfixed toner image) having a size of 25 mm by 25 mm was formed on the evaluation paper under the same conditions as those for measurement of the lowest fixable temperature. The evaluation paper with the image formed thereon was then allowed to pass through the fixing device of the evaluation apparatus. In doing so, the temperature of the fixing device was increased in increments of 2° C. from 130° C. and occurrence of offset was visually checked at respective fixing temperatures. A maximum temperature (highest fixable temperature) at which offset did not occur was then determined. Occurrence of offset was determined according to whether or not contamination due to attachment of toner to a fixing roller (contamination appearing at every rotation of the fixing roller) was observed on the evaluation paper. A value obtained by subtracting the above lowest fixable temperature from the maximum fixable temperature determined as above was determined to be a fixing temperature range (unit: ° C.). Table 2 shows results. A fixing temperature range of at least 40° C. was evaluated as "good", and a fixing temperature range of less than 40° C. was evaluated as "poor".

[Image Density (ID)]

A black solid image (specifically, an unfixed toner image) having a size of 25 mm by 25 mm was formed on the evaluation paper under the same conditions as those for measurement of the lowest fixable temperature. The evaluation paper with the image formed thereon was then allowed to pass through the fixing device of the evaluation apparatus. In doing so, a fixing temperature of the fixing device was set at the lowest fixable temperature determined in measurement of the lowest fixable temperature for a corresponding one of the toners used for evaluation. Next, an image density (ID) in a solid portion of the image formed on the evaluation paper was measured using a reflectance densitometer ("SPECTROEYE (registered Japanese trademark)", product of X-Rite Inc.). Table 2 shows results. An image density (ID) of at least 1.2 was evaluated as "good", and an image density (ID) of less than 1.2 was evaluated as "poor".

[Glossiness]

A black solid image (specifically, an unfixed toner image) having a size of 25 mm by 25 mm was formed on the evaluation paper under the same conditions as those for measurement of the lowest fixable temperature. The evaluation paper with the image formed thereon was then allowed to pass through the fixing device of the evaluation apparatus. In doing so, a fixing temperature of the fixing device was set at the lowest fixable temperature determined in measurement of the lowest fixable temperature for a corresponding one of the toners used for evaluation. A glossiness of a solid portion of the image formed on the evaluation paper was measured at a measurement angle of 60° using a handy gloss meter ("GLOSS CHECKER IG-331", product of HORIBA, Ltd.). Table 2 shows results. A glossiness of at least 25 was evaluated as "high glossiness", while a glossiness of less than 25 was evaluated as "low glossiness".

TABLE 2

| | Toner | Standard deviation SD | Area ratio $S_1$ (%) | Area ratio $S_2$ (%) | Number ratio NR (%) | Lowest fixable temperature (° C.) | Fixing temperature range (° C.) | Image density | Glossiness |
|---|---|---|---|---|---|---|---|---|---|
| Example 1 | TA-1 | 1.25 | 9 | 90 | 10 | 104 | 52 | 1.4 | 28 |
| Example 2 | TA-2 | 1.25 | 9 | 90 | 25 | 106 | 56 | 1.2 | 30 |
| Example 3 | TA-3 | 1.25 | 9 | 90 | 5 | 102 | 40 | 1.5 | 26 |
| Example 4 | TA-4 | 1.28 | 9 | 90 | 7 | 106 | 42 | 1.4 | 26 |
| Example 5 | TA-5 | 1.27 | 9 | 90 | 11 | 104 | 54 | 1.4 | 30 |
| Comparative Example 1 | TB-1 | 1.30 | 9 | 90 | 21 | 114 | 60 | 1.4 | 31 |
| Comparative Example 2 | TB-2 | 1.29 | 9 | 90 | 6 | 106 | 36 | 1.4 | 22 |
| Comparative Example 3 | TB-3 | 1.25 | 9 | 90 | 31 | 112 | 50 | 1.0 | 34 |
| Comparative Example 4 | TB-4 | 1.22 | 9 | 90 | 30 | 108 | 58 | 1.0 | 32 |
| Comparative Example 5 | TB-5 | 1.25 | 9 | 90 | 3 | 102 | 38 | 1.6 | 21 |

The toners TA-1 to TA-5 each included a number of toner particles (first particles) in each of which a core containing a binder resin and a colorant was covered with a shell layer and a number of toner particles (second particles) in each of which a core containing a releasing agent was covered with a shell layer. As shown in Table 2, a standard deviation SD of a volume-based particle size distribution of each of the toners TA-1 to TA-5 was at least 1.25 and no greater than 1.28. The toners TA-1 to TA-5 each had an area ratio $S_2$ of regions of the cores of the second particles that were occupied by the releasing agent of 90% in a cross-sectional image of the second particles. The toners TA-1 to TA-5 each had a number ratio NR of the second particles of at least 5% and no greater than 25%.

As shown in Table 2, the toners TA-1 to TA-5 each had a lowest fixable temperature of at least 102° C. and no greater than 106° C. The toners TA-1 to TA-5 each had a glossiness of at least 26 and no greater than 30.

As shown in Table 2, the toners TB-1 and TB-2 each had a standard deviation SD of a volume-based particle size distribution of greater than 1.28. The toners TB-3 and TB-4 each had a number ratio NR of the second particles of greater than 25%. The toner TB-5 had a number ratio NR of the second particles of less than 5%.

As shown in Table 2, the toners TB-1, TB-3, and TB-4 each had a lowest fixable temperature of at least 108° C. The toners TB-2 and TB-5 each had a glossiness of less than 25.

The above results indicated that use of the toner according to the present disclosure could increase glossiness of formed images while low-temperature fixability could be ensured.

What is claimed is:

1. A toner comprising toner particles including a plurality of first particles and a plurality of second particles, wherein the first particles and the second particles each include a core and a shell layer covering a surface of the core, the cores of the first particles contain a binder resin and a colorant, the cores of the second particles contain a releasing agent, a standard deviation of a volume-based particle size distribution of the toner is no greater than 1.28, an area ratio of regions of the cores of the second particles that are occupied by the releasing agent in a cross-sectional image of the second particles is at least 50%, and a number ratio of the second particles is at least 5% and no greater than 25% relative to a total number of the first particles and the second particles.

2. The toner according to claim 1, wherein the cores of the first particles further contain a releasing agent, and an area ratio of regions of the cores of the first particles that are occupied by the releasing agent contained in the cores of the first particles in a cross-sectional image of the first particles is at least 1% and no greater than 20%.

3. The toner according to claim 1, wherein the cores of the second particles contain no colorant.

4. The toner according to claim 1, wherein the binder resin includes a crystalline polyester resin and a non-crystalline polyester resin.

5. The toner according to claim 1, wherein the releasing agent contained in the cores of the second particles has an acid value of at least 5 mgKOH/g and no greater than 25 mgKOH/g.

6. The toner according to claim 5, wherein the releasing agent contained in the cores of the second particles includes a polyethylene oxide wax.

7. The toner according to claim 1, wherein an amount of the second particles is at least 5 parts by mass and no greater than 20 parts by mass relative to 100 parts by mass of the first particles.

8. The toner according to claim 1, wherein an absolute value of a difference in volume median diameter ($D_{50}$) between the cores of the first particles and the cores of the second particles is no greater than 1.5 μm.

* * * * *